United States Patent [19]

Krob et al.

[11] 4,245,851

[45] Jan. 20, 1981

[54] SKI BRAKE

[75] Inventors: Erwin Krob, Vienna; Josef Svoboda, Schwechat, both of Austria

[73] Assignee: TMC Corporation, Baar, Switzerland

[21] Appl. No.: 1,368

[22] Filed: Jan. 5, 1979

[30] Foreign Application Priority Data

Jan. 5, 1978 [AT] Austria ..... 74/78

[51] Int. Cl.[3] ..... A63C 7/10

[52] U.S. Cl. ..... 280/605; 188/5

[58] Field of Search ..... 280/605; 188/5, 6, 8

[56] References Cited

U.S. PATENT DOCUMENTS

| | | | |
|---|---|---|---|
| 4,014,563 | 3/1977 | Weigl et al. | 280/605 |
| 4,138,137 | 2/1979 | Beyl | 280/605 |
| 4,167,275 | 9/1979 | Weiss et al. | 280/605 |

FOREIGN PATENT DOCUMENTS

| | | | |
|---|---|---|---|
| 2413099 | 10/1975 | Fed. Rep. of Germany . | |
| 2412623 | 11/1975 | Fed. Rep. of Germany . | |
| 2554110 | 6/1977 | Fed. Rep. of Germany . | |
| 2659256 | 11/1977 | Fed. Rep. of Germany . | |
| 2304367 | 10/1976 | France | 280/605 |

*Primary Examiner*—John J. Love
*Assistant Examiner*—D. W. Underwood
*Attorney, Agent, or Firm*—Blanchard, Flynn, Thiel, Boutell & Tanis

[57] ABSTRACT

A ski brake made of spring wire and pivotally secured to a mounting plate which is in turn secured to the upper surface of a ski. The spring wire contains multiple bends therein with the spring wire being pivotally secured to the mounting plate about two axes which are spaced in the longitudinal direction of the ski. One of the pivot axes is centrally located on the mounting plate and movably supports the spring wire therein for movement toward the tip and tail of the ski. The other pivot axis of the ski brake is defined by a pair of laterally spaced axles which are located forwardly from the first-mentioned pivot axle and each are housed in bearing structures which will facilitate a pivoting of the axle about a vertical axis. This pivotal movement about the vertical axis can be by either making the axle housing the spring wire therein loose or by mounting the spring wire in a member which is in turn pivotally secured to the upper surface of the mounting plate.

6 Claims, 9 Drawing Figures

SKI BRAKE

FIELD OF THE INVENTION

The invention relates to a spring wire ski brake comprising two braking mandrels which project in the braking position next to the two lateral edges of the ski below the bottom surface of the ski, which braking mandrels are the free ends of a braking bar which is formed of the spring wire by repeatedly bending the wire, which braking bar can be pivoted into a retracted position about an axis which lies substantially at a right angle with respect to the longitudinal axis of the ski against the self-contained torsional force by means of a ski boot or by means of a sole plate or the like, and in which position the braking mandrels are held above and approximately parallel with respect to the upper side of the ski and the braking bar has two pivot axles which lie spaced from one another in the longitudinal direction of the ski, of which one of the axes is movably supported with respect to the other one in longitudinal direction of the ski.

BACKGROUND OF THE INVENTION

Such a ski brake is known approximately from German OS No. 24 13 099, published Oct. 2, 1975. However, same has the disadvantage that the braking mandrels are positioned along the two sides of the ski in the retracted position of the braking bar, which can result in their getting caught on obstacles projecting from the ground and this can result in a fall of the skier.

It is also known, for example from German OS No. 24 12 623, published Nov. 13, 1975, to design the braking mandrels retractable for the retracted position. However, either additional structural parts in the ski brake are needed for this, or the brake must have a special design. However, the special design is also associated with high manufacturing expenses due to required precision, because already small deviations from the aforedescribed technical information can lead to malfunctions.

This is where the invention comes in and has as its objective the provision of a ski brake of the above-mentioned type such that its braking mandrels can be "pulled in" above the upper side of the ski in the retracted position also without additional structural parts and without requirements as to excessive precision.

The set objective is attained according to the invention by the stationary axes of the braking bar being swingably supported with respect to the longitudinal axis of the ski.

The inventive pivotal support of the normally stationary axes of the braking bar assures a wide range of various technical solutions for pulling in the braking mandrels, without requiring excessive precision in the manufacturing process. Due to the fact that the other pivot axis of the braking bar, as is actually known, is movably supported in the longitudinal direction of the ski, certain inexactnesses in the manufacture can be balanced only through the structure of the entire ski brake.

DETAILED DESCRIPTION OF THE DRAWINGS

Further advantages, details and inventively important characteristics of the invention are described more in detail hereinafter with reference to several exemplary embodiments and the drawings, in which.

Figure 6:
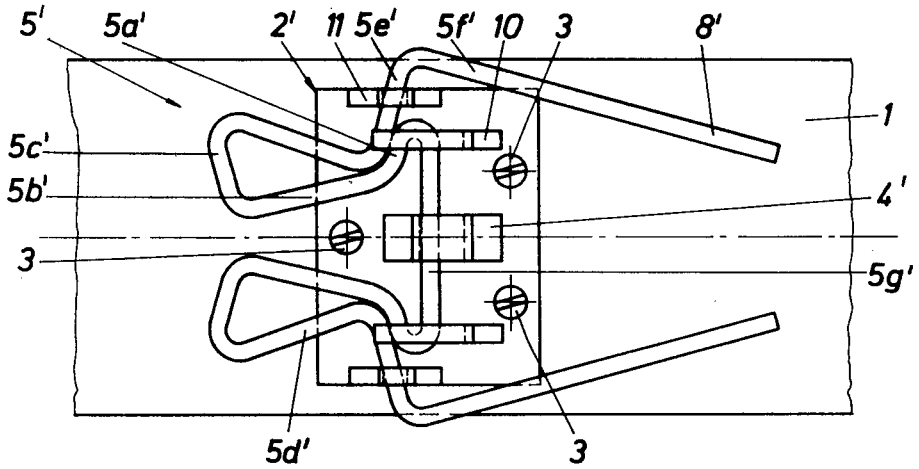
Figure 4:
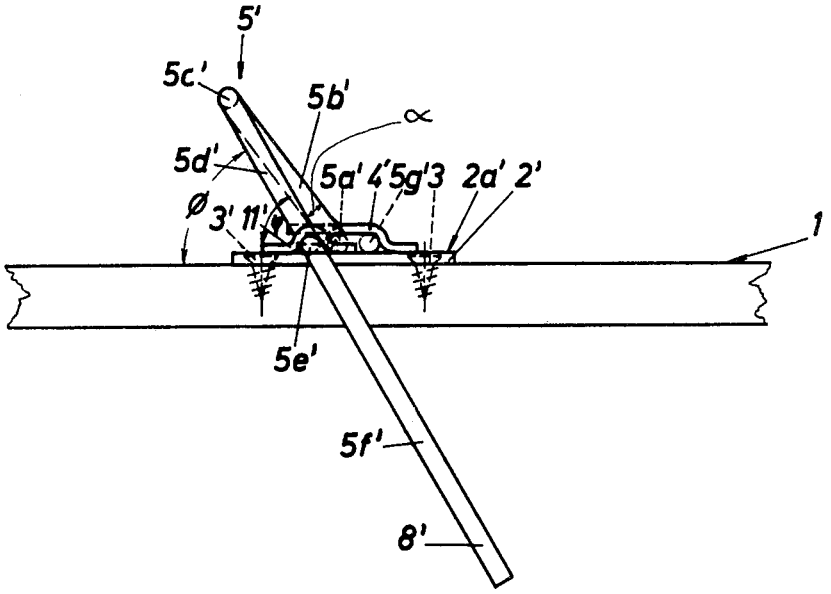
Figure 5:
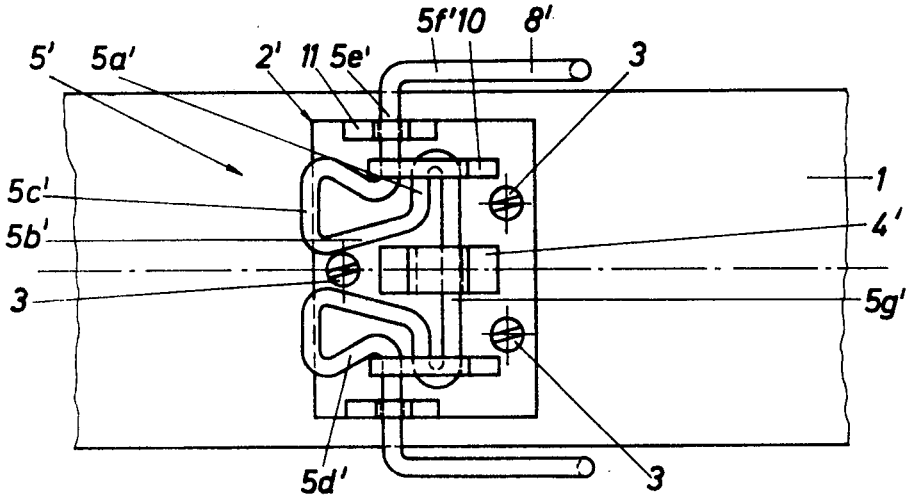
Figure 7:
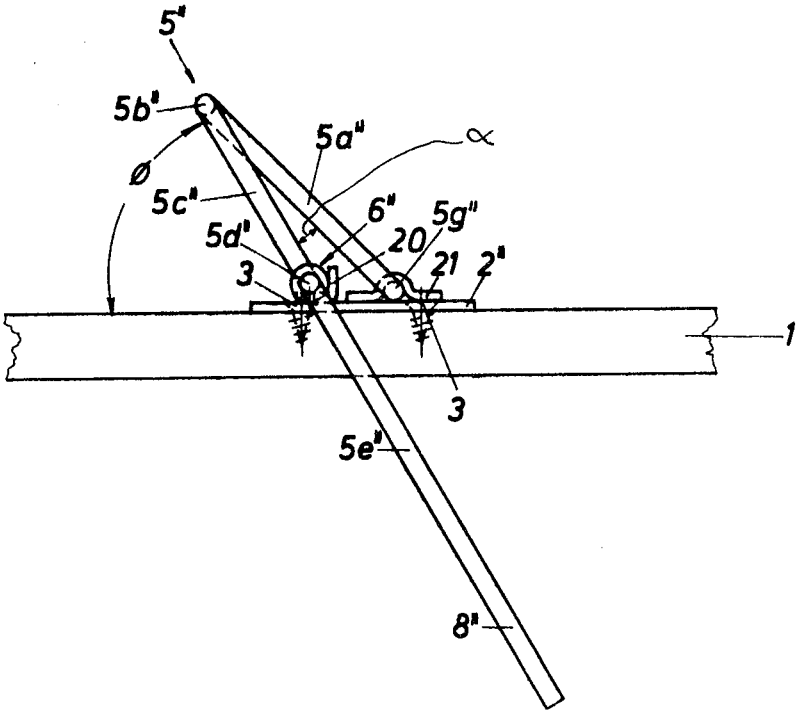
Figure 8:
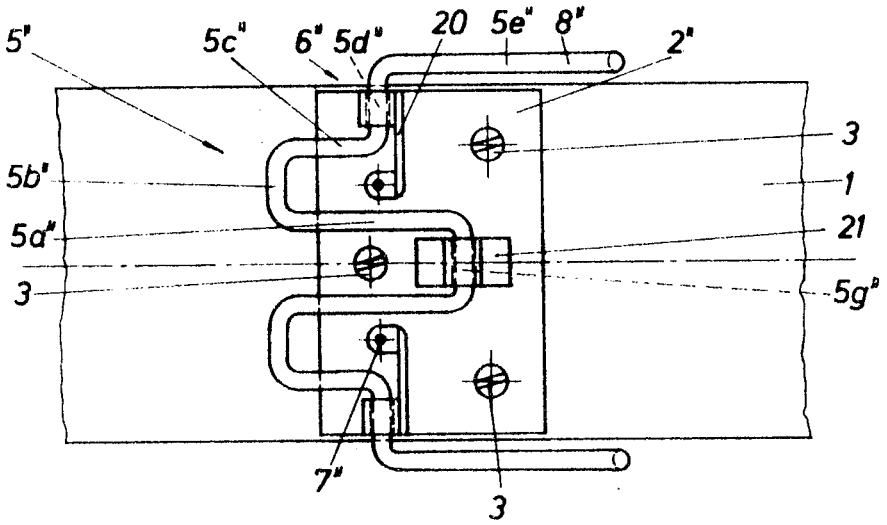
Figure 9:
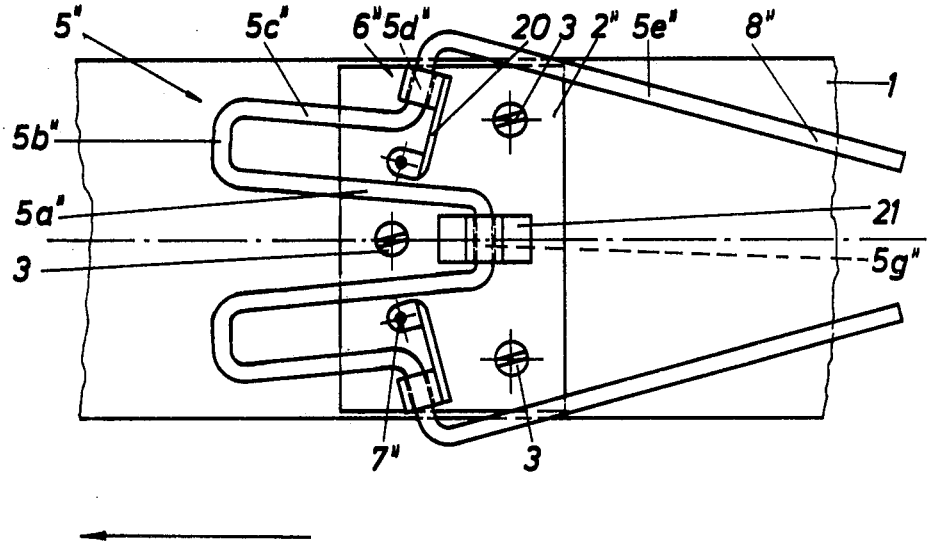
Figure 1:
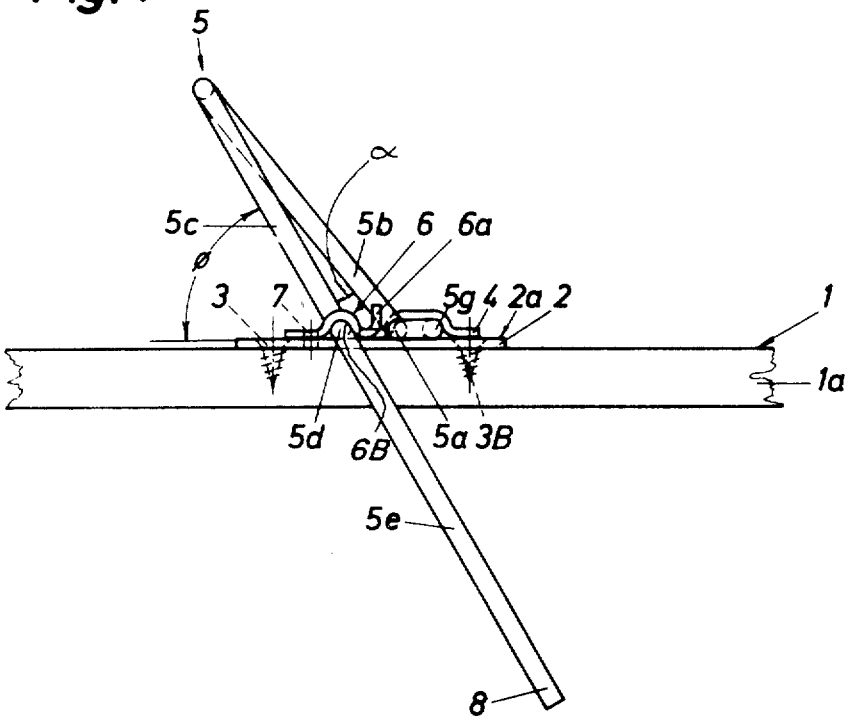
Figure 2:
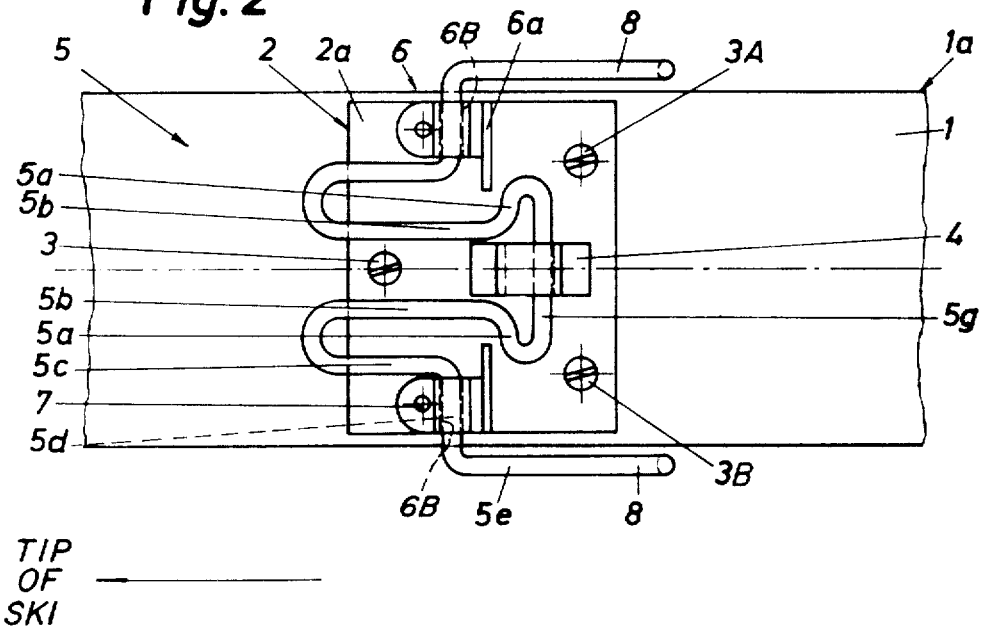
Figure 3:
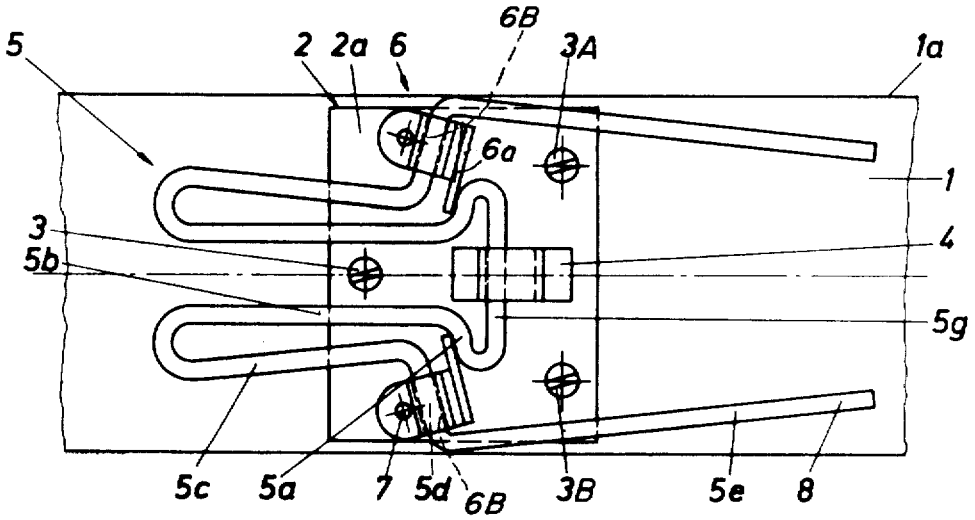
Figure 6:
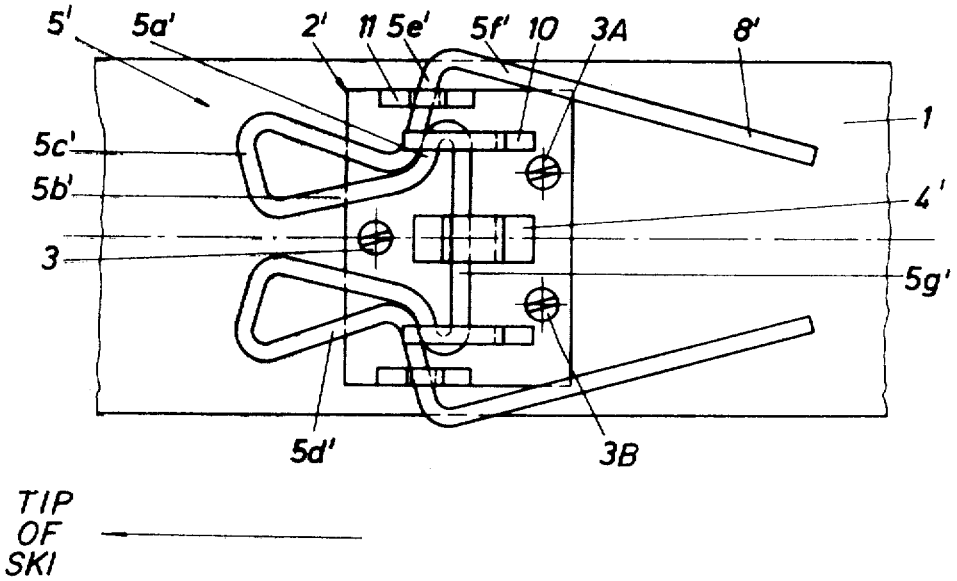
Figure 4:
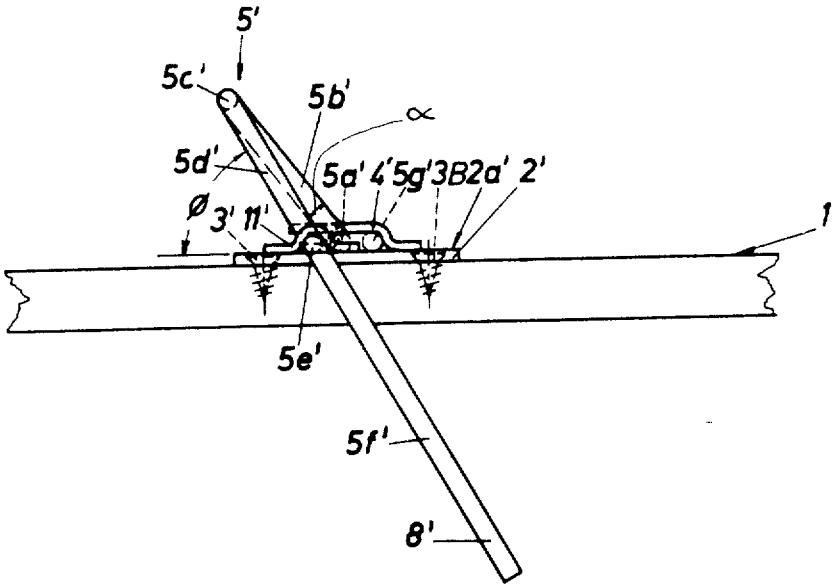
Figure 5:
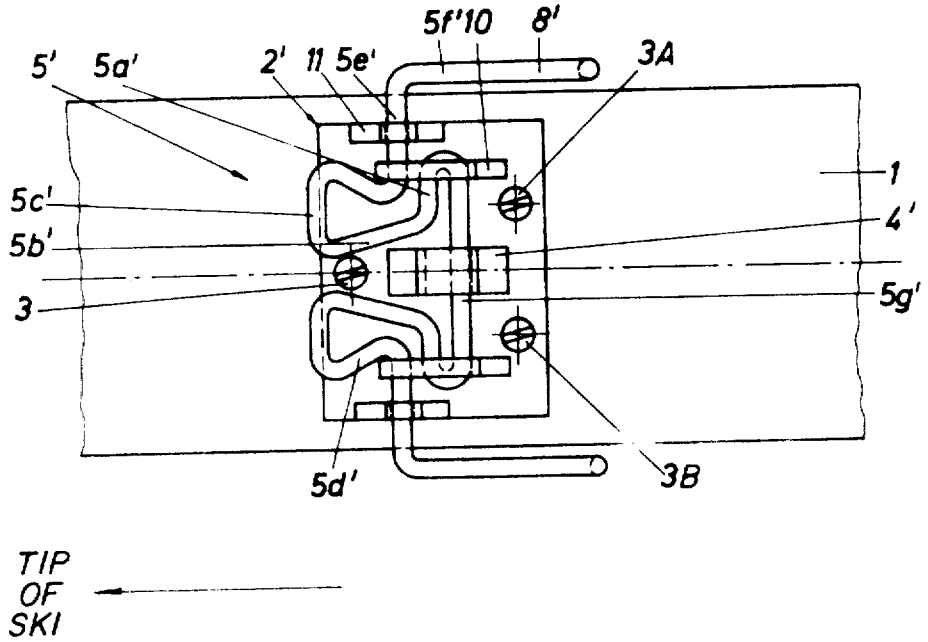
Figure 7:
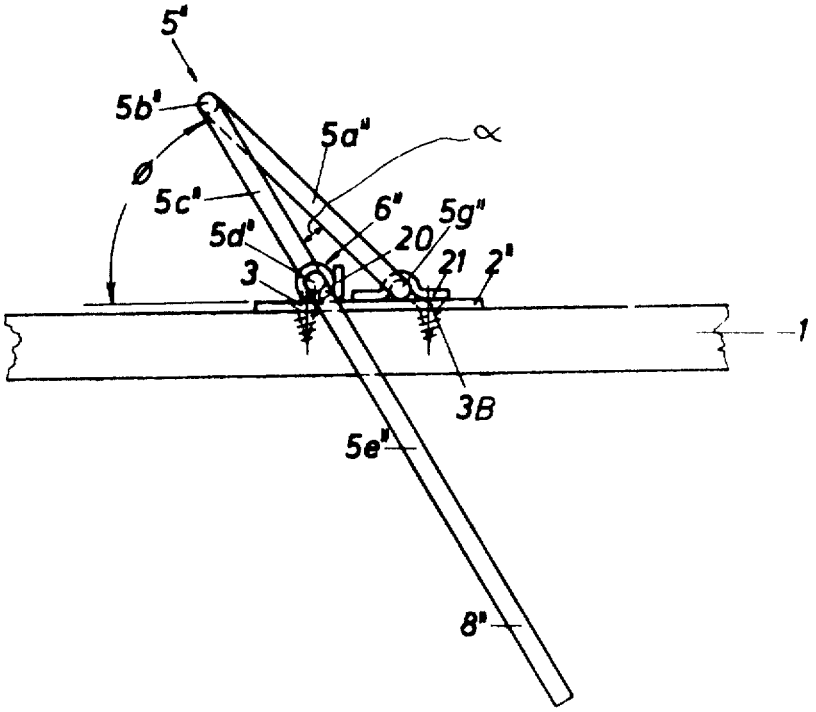
Figure 8:
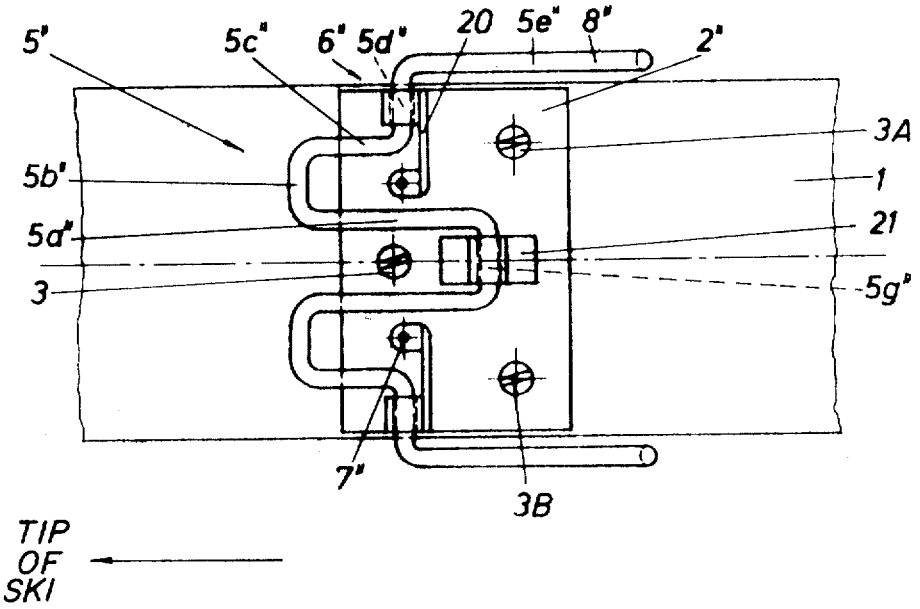
Figure 9:
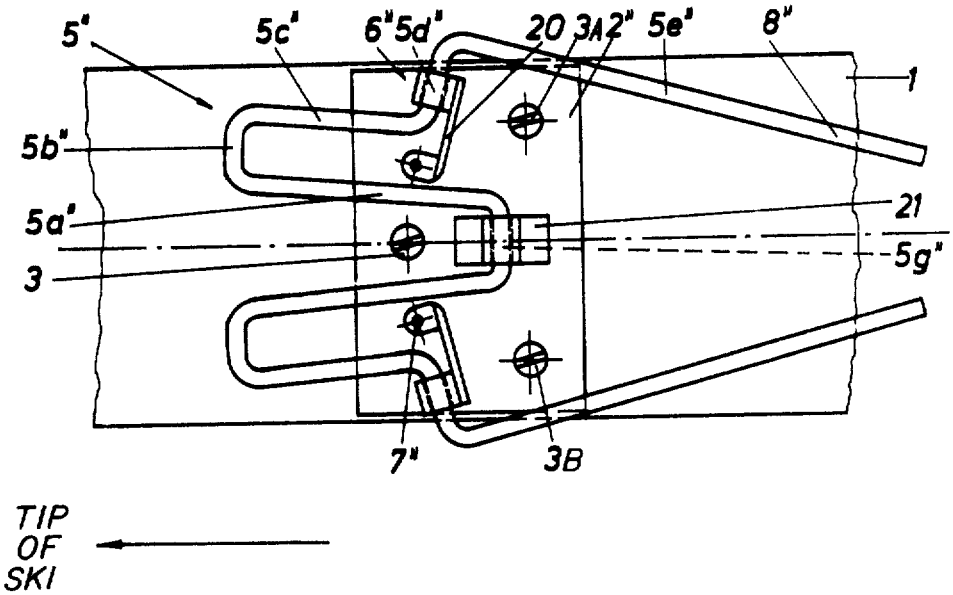

FIGS. 4 to 6 illustrate a different exemplary embodiment of an inventive ski brake, wherein FIG. 4 is a side view of the ski brake in the braking position, FIG. 5 is an associated top view of FIG. 4 and FIG. 6 illustrates the brake in the retracted position; and FIGS. 7 to 9 illustrate a further exemplary embodiment of an inventive ski brake, wherein FIG. 7 is a side view of the ski brake in braking position, FIG. 8 is an associated top view of FIG. 7 and FIG. 9 illustrates the ski brake in the retracted position.

DETAILED DESCRIPTION

Figure 1:
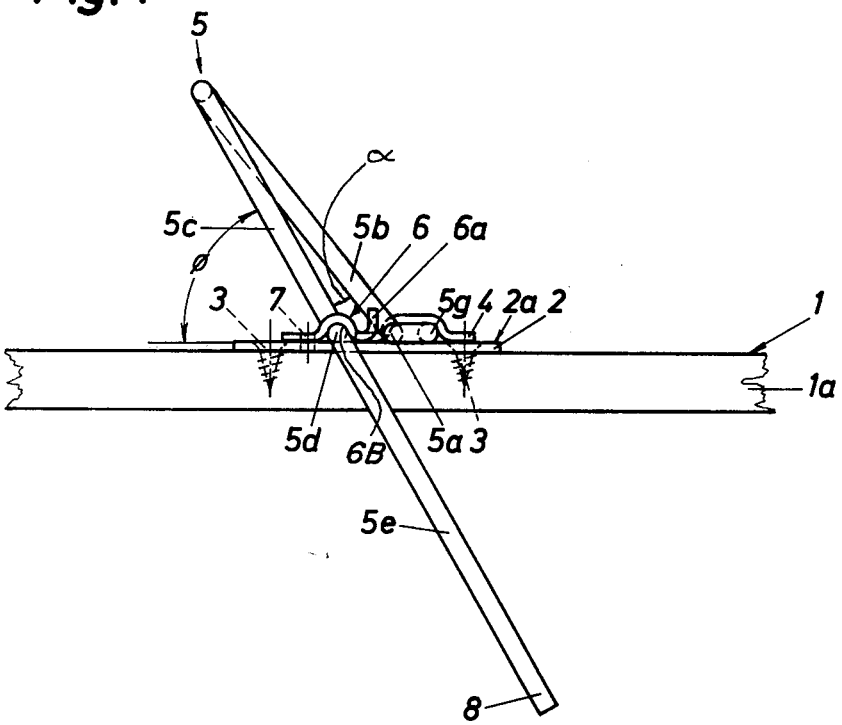
FIG. 1 illustrates a side view of a ski brake embodying the invention in the braking position.
Figure 2:
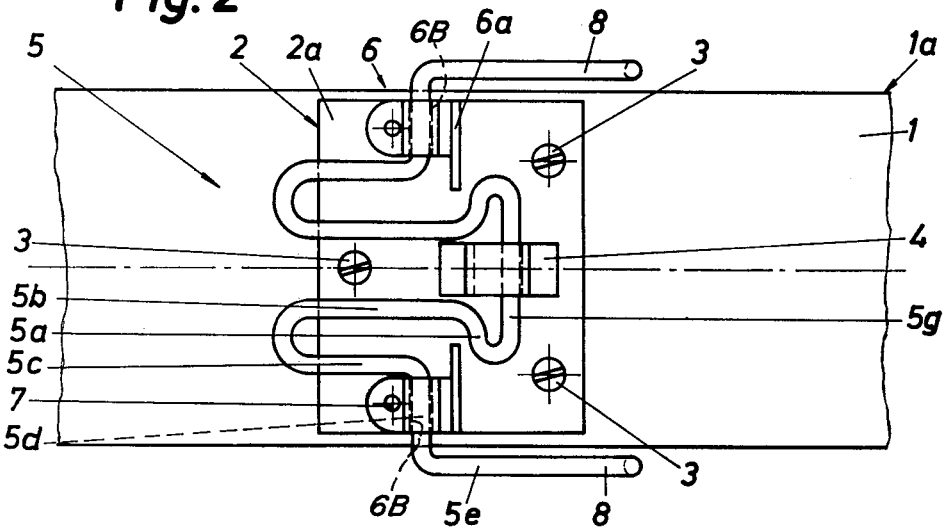
FIG. 2 is the top view of FIG. 1.
Figure 3:
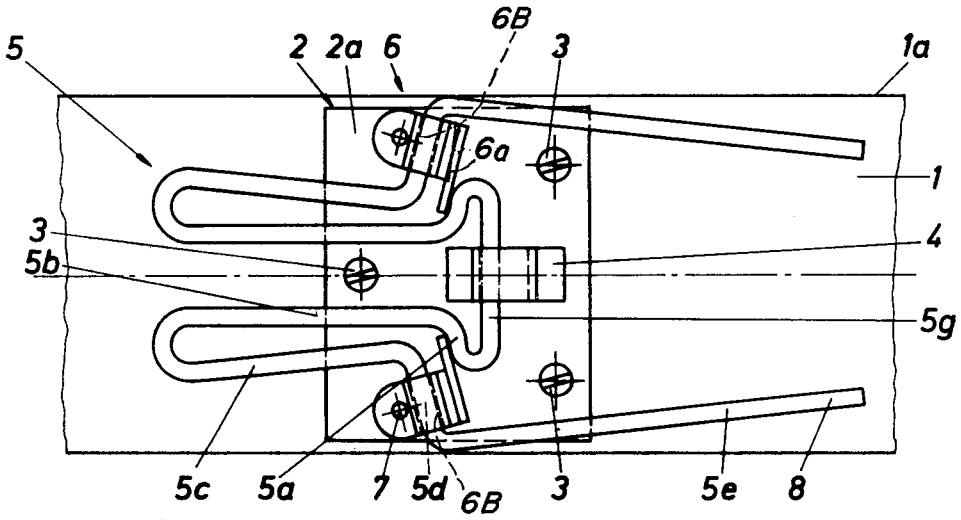
FIG. 3 illustrates the ski brake of FIG. 2 in the retracted position.

The ski brake which is illustrated in FIGS. 1 to 3 has the following structure. A substantially rectangular base plate 2 is secured to the upper surface of the ski 1 by means of three countersunk screws 3, 3A and 3B. The countersunk screws 3 are arranged so that one of the three countersunk screws 3 extends through the base plate 2 and into the upper surface of the ski at the end thereof adjacent the tip of the ski and on the central longitudinal axis of the ski. The other end of the base plate 2 is secured by means of two countersunk screws 3A and 3B located on opposite lateral sides of said central longitudinal center line and these are arranged such they form with the aforedescribed countersunk screw 3 a substantially equilateral triangle.

A bearing loop 4 is mounted on and secured to the rear half of the hose plate 2 in the region of the central longitudinal axis of the ski. The loop opens laterally outwardly and the band of material defining the loop extends parallel with respect to the longitudinal axis of the ski. The bearing loop 4 is constructed such that it permits the central portion a one-piece, substantially symmetricl braking bar 5, which will be described more in detail below, to move inside the loop in direction of the longitudinal axis of the ski.

A wire section **5*g* of the one piece braking bar 5 is received in the loop 4 and is supported for movement along the longitudinal axis of the ski. The wire section 5*g* extends substantially perpendicular to the longitudinal axis of the ski. Approximately at half way between the central longitudinal axis of the ski and each side wall of the ski 1*a*, the substantially symmetrical braking bar 5, particularly at the opposite ends of the wire section has the first of several bent sections thereat 5*a*. The bent sections 5*a* each curve toward the tip of the ski and the front part of the braking bar 5 and through a generally 180° angle. The bent sections 5*a* lie in a plane parallel to the upper side 2*a* of the base plate 2. Thereafter, second bent sections 5*b* are provided following the first bent sections 5*a*; the second bent sections 5*b* are designed so that the wire extends toward the tip of the ski at approximately 90° from the end of the wire sections 5*a* and out of the plane parallel to the upper side 2*a* of the base plate at an angle $\theta$ (see FIG. 1) of approximately 45°. The wire sections 5*b* extend frontwardly so that they considerably project beyond the front edge of the base plate 2 in the retracted position (see FIG. 3) of the braking bar 5. Thereafter, third bent sections 5*c* are provided which are connected to the second wire sections 5*b* through a 180° angle bend and are positioned laterally outside of the second wire sections 5b. Furthermore, the plane of the second wire sections 5b forms with the plane of the third wire sections 5c an angle $\alpha$ of approximately 5°-10°. The wire sections 5e are located frontwardly of the wire sections 5b. The two second and third wire sections 5b and 5c also lie in planes perpendicular to the upper surface 2a of the base plate 2 and which extend substantially parallel to one another in the braking position (FIG. 2) and generally toward the wire segment 5g**.

Fourth bent sections 5d connected to the third bent sections 5c through an approximately right angle in direction toward the lateral edges of the ski (not identified in detail). The fourth bent sections 5d are designed so that they project bent sections 5e are connected to the outer ends of the wire beyond the lateral edges of the ski. Fifth sections 5d through an approximate 90° angle and extend in vertical planes which are parallel to the aforesaid planes containing the wire sections 5b and 5c. In addition, the wire sections 5c, 5d and 5e are coplanar in the plane extending at the angle $\alpha$ with the wire sections 5b.

The fourth bent sections 5d define a pivot axle for the braking bar 5. An elongated bearing plate 6 is pivotally secured to the base plate 2 about a vertical axis 7. The pivot axes 7 are arranged on the ends of the bearing plates 6 facing the tips of the skis, such that the lateral edges thereof are flush with the side edges of the base plate 2 when the braking bar 5 is in the braking position. Each of the bearing plates 6 have at their ends which are remote from the axes 7 a 90° bent section 6a which extends upwardly away from the upper surface of the ski 1. The bent sections 6a also extend beyond the inner edge of the bearing plates 6 toward the center of the ski. The bearing plates 6 each have a channel 6B formed therein through which the wire sections 5d extend and are rotatable therein. The channels 6B define the pivot support for the wire sections 5c and 5e while the loop defines the pivot support for the wire sections 5a and 5b. It will be recognized that the wire section 5g slides in the loop between the forward and rearward extremities thereof.

The braking part of the braking bar 5 is arranged below the bearing loop 4 in the braking position according to FIGS. 1 and 2 at the terminal end of the same, which terminal end is remote from the tip of the ski. If the braking bar 5 is now stepped down upon, it will pivot about the axes of the channels 6B in the bearing plates 6 and will pull, caused by the different lengths of the second and third wire sections 5b and 5c, the movably supported wire section 5g of the braking bar 5 in the bearing loop 4 in the direction toward the tip of the ski. When the fifth bent sections 5e are swung so far that they lie above the two upper lateral edges of the ski, the part of the braking bar 5 which forms the first bent sections 5a loads during the last portion of its sliding movement toward the tip of the ski the upwardly projecting bent sections 6a of the bearing plates 6 to cause these sections to be pivoted about their respective axes 7 inwardly toward the central longitudinal axis of the ski (see FIG. 3). This pivoting movement is transmitted through the fourth bent sections 5d onto the fifth bent sections 5e to cause the free ends thereof, which define the braking mandrels 8, to flex inwardly over the lateral edges of the ski. The braking bar 5 is torsionally stressed in the stepped-down or retracted position in its regions between the first and second bent sections 5a and 5b, and between the second and the third bent sections 5b and 5c. This torsional spring force is stored within the wire to cause an upward swinging of the braking bar 5 as soon as same is released from engagement with the ski boot or from the plate or the wire segments 5a of the like. At the start of the upward swing, the braking bar 5 become disengaged from the bent sections 6a of the bearing plates 6. During this disengagement, the braking mandrels 8 are swung outwardly beyond the ski edges. The braking bar 5 pivots further due to the described spring force into the braking position, as it is illustrated in FIGS. 1 and 2.

The exemplary embodiment according to FIGS. 4 to 6 is constructed similarly to the one according to FIGS. 1 to 3. A base plate 2' is secured to the upper surface of the ski 1 by means of three countersunk screws 3, 3A and 3B which are arranged in a triangle arrangement as viewed from the top. The base plate 2' is slightly more narrow than is the ski 1. A bearing loop 4' is positioned centrally with respect to the longitudinal axis of the ski approximately in the center of the base plate 2'. A holding angle 10 is connected to the base plate 2' on each lateral side of the bearing loop 4', approximately in the center between the loop 4' and the edge of the base plate 2'. The holding angle is secured to the base plate 2' only at the rear end thereof and opens in the frontward direction toward the tip of the ski.

In the half of the base plate 2' which is closest the tip of the ski, there is arranged on each side thereof one suitably bent bearing strap member 11, such that it is in alignment with the outer side edge of the base plate 2'. The bearing straps each have an opening therethrough larger in size than the diameter of the axle segments 5e' to thereby loosely rotatably support the axle segments and facilitate an angular movement of the axle segments to positions which are oriented at an acute angle to the longitudinal axis of the ski as shown in FIG. 6.

A one-piece braking bar 5' has a wire section 5g' which extends through the bearing loop 4' substantially perpendicularly with respect to the longitudinal axis of the ski. The ends of the wire section 5g' extend beneath the holding part 10 and are bent thereat in a 180° angle toward the tip of the ski to thereby form the first bent section 5a'. The bent section 5a' lies in a plane parallel to the upper surface of the ski.

The braking bar 5' is also bent in direction toward the tip of the ski such that its second bent sections 5b' do not only extend toward the central longitudinal axis of the ski, but also project upwardly from the plane of the upper side 2a' of the base plate at an angle $\phi$ of approximately 45° (FIG. 4). The second bent sections 5b' connected through a fairly large angle bend to third bent sections 5c' extending laterally in direction toward the lateral edges of the ski substantially perpendicularly with respect to the longitudinal axis of the ski in the braking position (FIGS. 4 and 5) of the braking bar 5'. Fourth bent sections 5d' are connected to the third bent sections 5c' extend in direction toward the central tail of the ski and the longitudinal axis of the ski. Furthermore, the plane of the second bent sections 5b' forms with the plane of the fourth bent sections 5d' an angle $\alpha$ of approximately 5° to 10°. Thereafter, fifth bent sections 5e' are connected to the fourth bent sections and extend substantially perpendicularly with respect to the longitudinal axis of the ski in the braking position of the braking bar 5'. The fifth bent sections 5e' extend laterally beyond the lateral edges of the ski. Sixth bent sections 5f' are connected to the fifth bent sections 5e' and extend alongside of the lateral edges of the ski. The ends of the sixth bent sections 5f' form at the same time the braking mandrels 8'.

The operation of the ski brake from the braking position (FIGS. 4 and 5) into the retracted position (FIG. 6) is as follows. During a pressing down upon of the braking bar 5' in the area of its third bent section 5c', the braking bar pivots about the axis defined by the bearing strap 11. Due to the unequal lengths of the second bent sections 5b' and the fourth bent sections 5d', the wire section 5g' of the braking bar 5' extending through the bearing loop 4' and the first bent sections 5a' slide in direction toward the tip of the ski. Shortly before these parts of the braking bar 5' have reached their front endmost position in the bearing loop 4', the first bent sections 5a' engage the fifth bent sections 5e'. The parts of the fifth bent sections 5e', which parts lie within the two holding parts 10, are moved in direction toward the tip of the ski. This shifting causes a swinging of the fifth bent sections 5e' and is also transmitted onto the sixth bent sections 5f', which causes the sixth bent sections to swing to bring the braking mandrels 8' into a position overlapping the upper surface of the ski.

The force, which is needed for swinging the braking bar 5' from the retracted position (FIG. 6) into the braking position (FIGS. 4 and 5), is derived from the torsion of the braking bar 5' in the area between the first bent sections 5a' and the second bent sections 5b' and in the area of the third bent sections 5c'. The first bent sections 5a' among others slide in direction toward the tail of the ski to become disengaged from the fifth bent sections 5e' to cause the braking mandrels 8' to be swung from their pulled-in position into a position outside of the lateral edges of the ski. During the further course of the pivoting movement of the braking bar 5', it assumes the position according to FIGS. 4 and 5.

The third exemplary embodiment of the inventive ski brake is illustrated in FIGS. 7 to 9, and is substantially similar to the two exemplary embodiments which are illustrated in FIGS. 1 to 6.

A base plate 2'' is secured on a ski 1 by means of three countersunk screws 3, 3A and 3B similar to the two preceding exemplary embodiments. A bearing strap 21 is fixedly connected to the base plate 2'' and is centrally disposed on the longitudinal axis of the ski and on the half of the base plate 2'' remote from the tip of the ski. Bearing plates 6'' are pivotally secured to the base plate 2'' for movement about pivot axes 7''. Each axis 7'' is defined by a pin which is rigidly connected on each side of the central longitudinal center line of the ski and extends perpendicularly with respect to the plane of the base plate 2''. The pivot axes 7'' are spaced approximately equidistant from the countersunk screw 3.

Each of the bearing plates 6'' have a substantially tubular structural part which is rigidly connected to arms 20 which extend perpendicularly to the longitudinal axis of the ski, which arms are secured by the pin defining the pivot axis 7'' to the base plate 2''.

The braking bar 5'' has a wire section 5g'' which extends perpendicular to the axis of the ski through the bearing 21. At each end of the wire section 5g'', an approximate right angle first bent section 5a'' is provided so that the section 5a'' extends toward the tip of the ski. In the retracted position of the braking bar 5'' (FIG. 9), the first bent sections 5a'' project with approximately half of their length beyond the front edge of the base plate 2''. Second bent sections 5b'' are connected to the first bent sections 5a'', which second bent sections 5b'' extend toward the lateral edges of the ski. The second bent sections 5b'' are designed approximately just as long as the wire section 5g'' extending through the bearing. Third bent sections 5c'' are connected to the second bent sections 5b'' and extend from the plane of the sections 5g'', 5a'' and 5b'' in direction toward the ski 1 and form an angle $\alpha$ of approximately 15° to 20° with the aforesaid plane containing the first bent sections 5a''. Fourth bent sections 5d'' are connected to the third bent sections 5c'' through a 90° angle and are received in the tubular parts of the bearing plates 6''. The fourth bent sections 5d'' are designed so long that the outer ends to which the braking mandrels 8'' are connected will lie outside of the lateral edges of the ski.

Upon the application of a downward force on the braking bar 5'' in the area of the second bent sections 5b'', the braking bar 5'' pivots clockwise in the bearing 21. Due to the different length of the first and third bent sections 5a'' and 5c'' and the location of the various bearing axles of the braking bar 5'', the wire is subjected to torsional stress. By torquing the braking bar 5'', all parts of the braking bar 5'' which lie within the bearing plates 6'' are swung in direction toward the outer edges of the ski or the bearing plates 6'' are swung in direction toward the tail of the ski. This swinging motion effects a pulling in of the braking mandrels 8'' above the upper surface of the ski.

The erecting force which is necessary for swinging the braking bar 5'' from the retracted position (FIG. 9) into the braking position (FIGS. 7 and 8) is achieved by the torsion of the braking bar 5'' in the area of the second bent sections 5b'' and corresponds with the force with which the braking bar 5'' resists the torsion when the angles $\alpha$ which are formed by the first bent sections 5a'' and the third bent sections 5c'' become smaller or approach 0.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a ski brake device for a ski having a spring wire bar with braking mandrels supported on a base plate adapted to be secured to an upper surface of said ski, said bar being movable automatically under spring action from a retracted position wherein said braking mandrels extend above said ski into a braking position wherein said braking mandrels project downwardly from said ski on opposite sides thereof, said bar having a pair of axle segments extending substantially at a right angle with respect to the central longitudinal axis of said ski when said bar is in said braking position and a central portion integral with said axle segments and extending therebetween, said central portion having a shape that is symmetrical about said central longitudinal axis and consisting of a pair of laterally spaced first segments integral with and extending at a first angle from an end of said axle segments remote from said braking mandrels, a pair of transversely extending second segments integral with and extending at a second angle from an end of said first segments remote from said axle segments, a pair of laterally spaced third segments integral with and extending at a third angle from an end of said second segments remote from said second segments and a fourth segment integral with and connecting said pair of third segments together, said base plate having first and second longitudinally spaced bearing means thereon for pivotally supporting said axle segments and said fourth segment, the improvement comprising wherein said first segments are shorter in length than said third segments, wherein said fourth segment extends perpendicularly to said longitudinal axis of said ski with the end portions thereof extending coextensively with at least a portion of each of said axle segments but spaced longitudinally therefrom, wherein one of said first and second bearing means includes first means for supporting each of said axle segments for angular movement about an upright axis perpendicular to said upper surface of said ski, wherein the other of said first and second bearing means includes means for supporting said fourth segment for movement toward said axle segments in response to a pivoting of said bar from said braking position to said retracted position, said end portions directly engaging at least one of said firsst and second bearing means and said portions of said axle segments at a location spaced laterally inwardly of said first means which supports said axle segments for angular movement whereby a continued movement of said fourth segment will cause said axle segments to be urged to a position, while being maintained in a plane parallel to said upper surface of said ski, wherein the longitudinal axes of each of said axle segments become oriented at an acute angle to said longitudinal axis of said ski and said braking mandrels extend over said upper surface of said ski.

2. The ski brake according to claim 1, wherein said first means includes a pair of bearing plates pivotally secured to said base for movement about said upright axis, each of said bearing plates including a hollow cylindrical housing means for rotatably supporting one of said axle segments therein.

3. The ski brake device according to claim 2, wherein each of said bearing plates includes a bent section thereon extending laterally inwardly and away from said upright axis, said end portions of said fourth segments engaging said bent sections in response to a movement of said bar from said braking position to said retracted position to effect a pivoting of said bearing plates about said upright axis to swing said braking mandrels over said upper surface of said ski.

4. The ski brake device according to claim 1, wherein said first means includes a pair of bearing straps loosely rotatably supporting each of said axle segments, the difference in length between said first and third segments causing, upon a movement of said bar from said braking position to said retracted position, said orienting of said axle segments at said acute angle.

5. The ski brake device according to claim 4, wherein intermediate said first and second bearing means and on said base plate there is provided a pair of holding parts slidingly holding said end portions of said fourth segment to prevent a flexing of said end portions upwardly away from sad upper surface of said ski while simultaneously facilitating said movement of said fourth segment and said end portions thereof toward and away from said axle segments.

6. In a ski brake device for a ski having a spring wire bar with braking mandrels supported on a base plate adapted to be secured to an upper surface of said ski, said bar being movable automatically under spring action from a retracted position wherein said braking mandrels extend above said ski into a braking position wherein said braking mandrels project downwardly from said ski on opposite sides thereof, said bar having a pair of axle segments extending substantially at a right angle with respect to the central longitudinal axis of said ski when said bar is in said braking position and a central portion integral with said axle segments and extending therebetween, said central portion having a shape that is symmetrical about said central longitudinal axis and consisting of a pair of laterally spaced first segments integral with and extending at a first angle from an end of said axle segments remote from said braking mandrels, a pair of transversely extending second segments integral with and extending at a second angle from an end of said first segments remote from said axle segments, a pair of laterally spaced third segments integral with and extending at a third angle from an end of said second segments remote from said second segments and a fourth segment integral with and connecting said pair of third segments together, said base plate having first and second longitudinally spaced bearing means thereon for pivotally supporting said axle segments and said fourth segment, the improvement comprising wherein said first segments are shorter in length than said third segments, wherein a pair of bearing plates are provided which are pivotally secured to said base plate for movement about said upright axis, each of said bearing plates including a hollow cylindrical housing means for rotatably supporting one of said axle segments therein, and wherein said upright axis for each of said bearing plates is oriented closer to said central longitudinal axis of said ski than said hollow cylindrical housing means.

* * * * *

UNITED STATES PATENT AND TRADEMARK OFFICE

CERTIFICATE OF CORRECTION

PATENT NO. : 4,245,851

DATED : January 20, 1981

INVENTOR(S) : Erwin Krob et al.

It is certified that error appears in the above—identified patent and that said Letters Patent is hereby corrected as shown below:

Figures 1 to 9, should appear as shown on the attached sheets.

Column 7, line 15, after "includes" insert -- second --.

line 19, "firsst" should read -- first --.

line 31, after "brake" insert -- device --.

line 33, after "base" insert -- plate --.

Column 8, line 8, "sad" should read -- said --.

Signed and Sealed this

*Eighteenth* Day of *August 1981*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4 245 851

DATED : January 20, 1981

INVENTOR(S) : Erwin Krob and Josef Svoboda

It is certified that error appears in the above—identified patent and that said Letters Patent is hereby corrected as shown below:

Column 8, line 41; after "wherein" insert ---said first bearing means comprises---.
delete "are".
line 42; delete "provided".
line 43; change "said upright axis" to ---separate upright axes---.
line 46; change "said upright axis" to ---separate upright axes---.

Signed and Sealed this

*Thirteenth* Day of *April 1982*

[SEAL]

*Attest:*

GERALD J. MOSSINGHOFF

*Attesting Officer*

*Commissioner of Patents and Trademarks*